United States Patent [19]

Friz

[11] 4,268,778

[45] May 19, 1981

[54] TRAVELING WAVE DEVICE WITH UNIFIC SLOW WAVE STRUCTURE HAVING SEGMENTED DIELECTRIC SUPPORT

[75] Inventor: Walter Friz, Yellow Springs, Ohio

[73] Assignee: Louis E. Hay, Dayton, Ohio ; a part interest

[21] Appl. No.: 52,340

[22] Filed: Jun. 27, 1979

[51] Int. Cl.[3] ..... H01J 25/34

[52] U.S. Cl. ..... 315/3.5; 29/25.14; 29/25.17; 29/600; 315/3.6; 315/39.3

[58] Field of Search ..... 29/600, 25.14, 25.17; 315/3.5, 3.6, 39.3

[56] References Cited

U.S. PATENT DOCUMENTS

| | | | |
|---|---|---|---|
| 3,519,964 | 7/1970 | Chorney et al. | 315/3.5 X |
| 3,610,999 | 10/1971 | Falce | 315/3.5 |
| 3,670,196 | 6/1972 | Smith | 315/3.5 |
| 3,670,197 | 6/1972 | Unger | 315/3.5 |
| 3,691,630 | 9/1972 | Burgess et al. | 315/3.5 |
| 4,115,721 | 9/1978 | Friz | 315/39.3 |

*Primary Examiner*—Saxfield Chatmon, Jr.
*Attorney, Agent, or Firm*—Louis E. Hay

[57] ABSTRACT

A traveling wave device, or the like, having an internal metallic helical core element which has a plurality of particulate deposition deposited dielectric segments to form an unific slow wave structure having an improved balance between the heat conductive and electrical requirements of said slow wave structure; and methods for forming said balanced slow wave structure.

18 Claims, 8 Drawing Figures

TRAVELING WAVE DEVICE WITH UNIFIC SLOW WAVE STRUCTURE HAVING SEGMENTED DIELECTRIC SUPPORT

REFERENCE TO RELATED PATENT

U.S. Pat. No. 4,115,721 Traveling Wave Device With Unific Composite Metal Dielectric Helix And Method For Forming; Friz.

BACKGROUND OF THE INVENTION

The present invention relates generally to the field of traveling wave devices and tubes, and more specifically to the production of such devices containing an unific composite metallic dielectric helical slow wave structure in which the dielectric is segmented on the peripheral surface of the metallic helical element for improved balance between the heat conductive and electrical requirements of the slow wave structure.

One of the most serious problems with traveling wave devices, to which the present invention relates, has been to dielectrically support the delicate internal metallic element of the slow wave structure by means having adequate heat conductive capacity without excessive dielectric loading and subsequent reduction in the RF output of the device. The above requirements are counterproductive and can be resolved only by a judicious compromise in the design geometry of the dielectric support. For increase in RF output power, the limiting factor prior to slow wave structures in accordance with the referenced U.S. Pat. No. 4,115,721 has been the heat conductive capability of the slow wave structure.

The physics of the dual function of the dielectric helix support and the consequential problems are well known to the art, for which reason they will not be discussed in detail. It will be noted that covering the entire peripheral surface of the metallic helical structure with a dielectric will promote strong dielectric loading effects, thus changing the phase velocity, its dispersion, and the impedance of the RF circuit. In many applications these changes lead to less desirable characteristics of the circuit.

What is tolerable, or may even be desirable under some design configurations and operating specifications, will not be likewise regarded under other specific requirements. The problem is one of compromise or balance between electromagnetic and thermal circuit capability. Slow wave structures in accordance with U.S. Pat. No. 4,115,721 are ideally suited for some applications; however, in other applications it would be desirable for overall effectiveness to bias the balance somewhat in favor of the electrical requirements; or in other words, to somewhat reduce any surplus heat conductive capacity of the continuous dielectric in favor of the electrical requirements, while at the same time retaining adequate heat conductive capacity.

Slow wave structures in accordance with U.S. Pat. No. 4,115,721 are stated to be "unific" in that the metallic and the dielectric portions of the structure have been united into a whole to a far greater extent than by prior methods. The particulate deposition of the dielectric is very dense, has a superior bond, and greatly improved heat conductive capacity. As will be explained below, the present invention is to remove any surplus heat conductive capacity by segmenting the dielectric while retaining its desirable unific characteristic in relationship to the central metallic element.

SUMMARY OF THE INVENTION

In accordance with the teachings of the present invention, a traveling wave device is provided which utilizes a slow wave structure having an improved balance between the heat conductive and the electrical requirements. Prior to the teachings of U.S. Pat. No. 4,115,721 the major problem was to provide dielectric support having sufficient heat conductive capacity to prevent overheating of the metallic portion of the slow wave structure.

Slow wave structures in accordance with U.S. Pat. No. 4,115,721 have overcome the heat transfer deficiency, and such slow wave structures are proving themselves to meet the objectives of improved traveling wave devices operable with greatly increased electrical output, while being much cheaper to manufacture and having an expanded operational life.

The principal object of the present invention is to make further improvement in traveling wave devices by improving the balance of unific slow wave structures by reduction of any surplus heat conductive dielectric and biasing the design toward improved electrical characteristics.

Prior art, as for example U.S. Pat. No. 3,519,964 Chorney et al, teaches one method for constructing a helical slow wave structure having segmented dielectric support. U.S. Pat. No. 3,670,196 Smith teaches a method for constructing a helical slow wave structure having continuous dielectric support. Both teachings, because of fabrication limitations, are limited to the construction of slow wave structures of relatively large size for use in low frequency traveling wave devices.

The present interest is in slow wave structures for frequency ranges commencing with X Band frequencies and higher. The calculated size for a slow wave structure suitable for use in the lower edge of the X Band is: Inside Diameter 0.3 cm(118 mil); Pitch 0.2 cm(78 mil); Ribbon Width 0.1 cm(39 mil); and Ribbon Thickness 0.02 cm(8 mil).

The art has not been able to build a slow wave structure of such small size by any conventional method; however, such structures are being built at the present time by applicant's "unific" method by which the dielectric is particulate deposited onto the perimeter of the inner metallic core element as by plasma spraying. For purposes of the present invention the maximum inside diameter of the inner metallic core element is restricted to 0.3 cm which is far below the minimum size of slow wave structures capable of being built in the conventional manner, or by any method other than in accordance with the teachings of applicant's referenced U.S. Pat. No. 4,115,721.

As will be described below, there are three species of such improved slow wave structures; the primary differences being in the manufacturing techniques. In the first species, a slow wave structure having a continuous dielectric on the periphery of the metallic helix is further machined to have a plurality of longitudinal slots machined into or through the dielectric portion to segment the dielectric. This additional machining is preferably performed before etching the mandrel on which the slow wave structure is formed.

In the second species, the helical slow wave structure is ground to desired diameter while on the forming mandrel. The combined slow wave structure and mandrel are then interference fitted, brazed, or otherwise bonded into a tube, after which the dielectric is segmented; as for example, by a small grinding wheel cutting through appropriate positions on the tube and penetrating into or through the dielectric portion of the slow wave structure.

In the third species, the segmented dielectric is formed on a mandrel having a plurality of disposable longitudinal bars which divide the segments at the time the dielectric is deposited onto the mandrel.

DESCRIPTION OF THE PREFERRED EMBODIMENT

Figure 1:
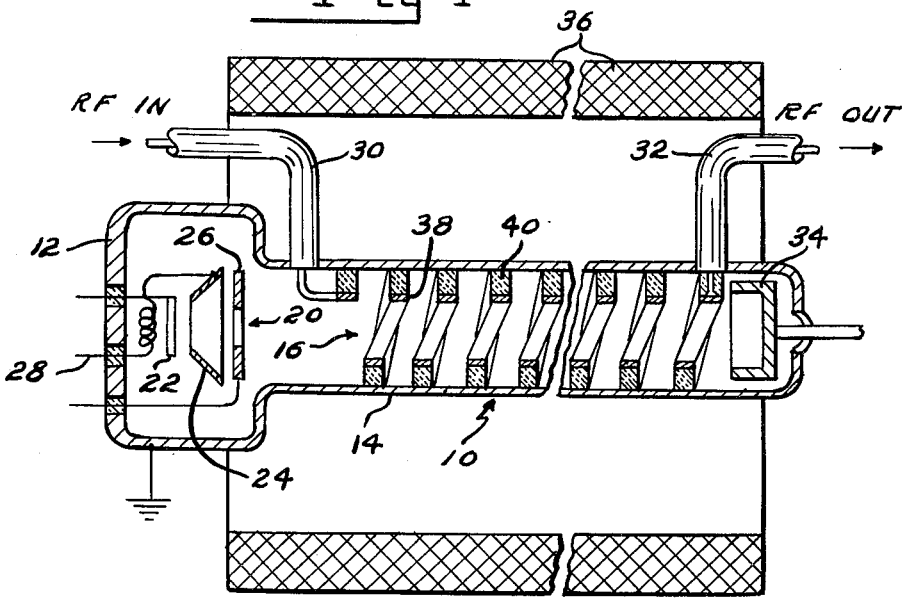
FIG. 1 is a cross-sectional view of a traveling wave device utilizing a slow wave structure in accordance with the present invention.

Referring to FIG. 1 which incorporates the embodiment of the invention, the traveling wave device 10 has an elongated metallic body member 12 having a longitudinal tubular body element 14. Supported within the longitudinal tubular body element in fixed relationship is an unific helical slow wave structure 16 which will be described in greater detail below.

Housed and supported within one end of the body member 12 is a conventional electron gun 20 having a cathode 22, a focusing electrode 24 and an accelerating anode 26. Suitable DC is applied through leads 28. The electron gun is positioned to project its electron beam output coaxial with the longitudinal axis of slow wave structure 16. As depicted, the electron gun is longitudinally displaced from the first end of slow wave structure 16. As further depicted, the portion of body member 12 which houses the electron gun 20 is of larger diameter than the portion of the body member housing the slow wave structure. This is not a requirement except in situations where the envelope of the electron gun is of diameter larger than that of the slow wave structure.

RF energy is coupled to the metallic portion of the slow wave structure as depicted by means of input line 30 and output line 32. Such lines are well known to the art and need not be described in detail.

A collector 34 is housed and dielectrically supported within body member 14. The collector is longitudinally displaced from the second end of slow wave structure 16 and is preferably coaxial with the slow wave structure and the electron gun 20. The collector collects and dissipates the electrons spent from the second end of the slow wave structure in a manner well known to the art.

The body member 12 is encompassed by a magnetic means such as a solenoid magnet 36 which is coaxial with the electron beam being propagated on the axis of the slow wave structure 16. The purpose of the magnetic means is to prevent beam spread and deviation.

The slow wave structure comprises a metallic ribbon 38 and a dielectric 40. In FIG. 1 the ribbon is shown as an unifilar helix for illustrative purposes. Within the scope of the present invention, the "helix" may take geometric forms other than unifilar, as for example, multifilar or a cross-wound helix. These so-called "helices" all have the function of interacting in a specific manner with the electron beam propagating therethrough. In other words, regardless of their exact configuration, they perform the same electrical function.

The peripheral surface of the ribbon 38 has a dielectric 40 bonded thereto. This dielectric is a deposition applied in a particulate form by a method such as by chemical deposition or by the arc plasma spray method. Within the scope of the present invention, the dielectric may be referred to as a dielectric deposition, since it is formed by a particulate deposition process rather than being a discrete whole which is mechanically applied in compliant form. This dielectric deposition is more firmly bonded to the metallic core, has a greater density, and is a better thermal conductor than a comparable dielectric material which is mechanically applied to the core.

As will be further described below, this dielectric deposition is segmented either during or after the deposition operation and provides a method for attaining improved balance between the heat conductive and the electrical requirements under specific operational specifications to which the traveling wave device is designed.

Figure 2:
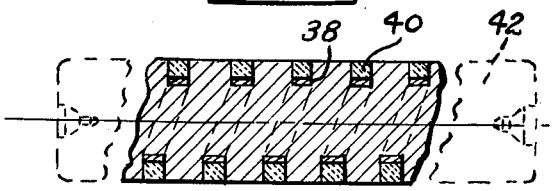
FIG. 2 depicts a portion of a disposable mandrel on which the metallic helical portion of the slow wave structure is wound and the dielectric is applied.

Reference is now made to FIG. 2 which shows a typical disposable mandrel 42, partially in cross-section, and showing one manner of forming a typical helical slow wave structure. The initial slow wave structure is identical with the structure taught in U.S. Pat. No. 4,115,721; that is, a metallic ribbon is wound on the mandrel and is then covered on the exposed surface with a particulate deposition dielectric 40.

The mandrel is formed of a material which will chemically react with the etching fluid to be used. The mandrel is preferably turned to a diameter slightly larger than the diameter of the finished slow wave structure. A helical thread is cut onto the mandrel to a predetermined pitch commensurate with the frequency requirements of the traveling wave device. The root diameter of the helical thread is substantially the inside diameter of the slow wave structure. The width of the helical thread is preferably the minimum width which will receive the metallic ribbon 38. The helical thread may be a square cut thread; that is, the sides of the thread are parallel. This form of thread eliminates any possibility of longitudinal overlap between the ribbon 38 and the dielectric which is to be externally applied. As indicated in FIG. 2, the mandrel may have lathe centers for supporting the mandrel in fixtures during the course of manufacture. The mandrel may also be held by collets or other holding devices, all of which are well known to the art.

After the mandrel is formed, a metallic ribbon 38, in strip form, is wound against the root diameter of the helical thread. The dielectric is now applied to the exposed surface of the metallic ribbon by particulate deposition such as by the arc plasma spray method. Enough of the dielectric material is applied to at least completely fill the helical thread in the mandrel. It is preferable to apply a surplus of dielectric material to assure that there are no cavities in the finished structure. The mandrel and dielectric are now precision machined to the predetermined diameter, as by centerless grinding.

Figure 3:
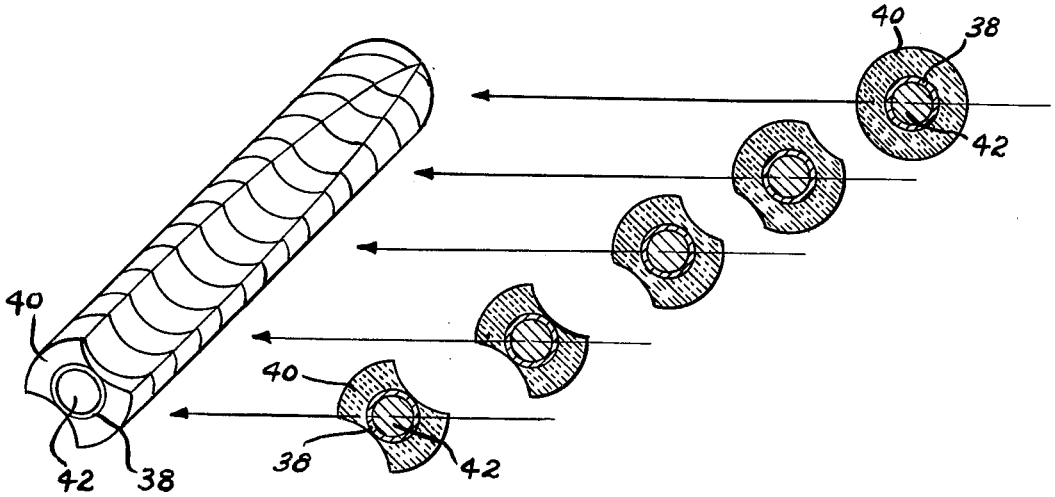
FIG. 3 is an enlarged perspective of a slow wave structure on a mandrel as shown in FIG. 2 and depicting one form of the machined segmented dielectric elements.

The next preferred step in producing a slow wave structure having segmented dielectric supports is to machine the continuous dielectric into segments. FIG. 3 illustrates one form of segmentation. A suitably contoured grinding wheel in a precision grinding machine is longitudinally fed along the slow wave structure-mandrel assembly at variable depth to produce variable depth cuts in the dielectric over the length of the structure. These tapered cuts or flutes allow the adjustment of the circuit phase velocity along the axis in a manner for optimal RF performance of the traveling wave device.

Figure 4:
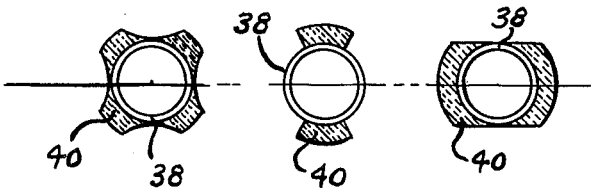
FIG. 4 shows typical transverse cross-sections of finished slow wave structures looking down the longitudinal electron beam passage and depicting three of the possible configurations of segmented dielectric supports which may be machined.

Three examples of the more common configurations of segmented dielectric in accordance with the present invention are illustrated in FIG. 4 which shows transverse cross-sections of typical structures. Within the scope of the present invention, any number of two or more segments about the metallic helix may be formed; likewise, the depth to which the dielectric is machined may be variable as illustrated in FIG. 3, or, the depth may be uniform over the entire length of the structure as illustrated in FIG. 4. Also, within the scope of the invention, the cuts may be made through the dielectric down to bare metal, or, the cuts may stop short of exposing metal.

After the dielectric has been segmented, the disposable mandrel may be removed to leave the finished slow wave structure, or in the alternative, the slow wave structure-mandrel assembly may be installed in the traveling wave device before deposition of the mandrel by chemical etching.

Although not limited to such material, under the present state of the art the preferable material for the dielectric is a ceramic such as beryllium oxide. Magnesium oxide and aluminum oxide are also suitable materials. If desired, a small amount of silicate or powdered glass may be added to the oxide for cohesion improvement.

Since the ribbon 38 is metallic, as well as the mandrel 42 which is to be removed by chemical etching, there must be a proper selection of metals and etching fluids. The ribbon must be of a material impervious to the etching fluid. For example, tungsten may be used for the ribbon, the mandrel may be made of molybdenum, and the etching fluid may be a solution of 50–75% formic acid and 25–50% hydrogen peroxide. There are other combinations of materials which may be used. A good reference is "Corrosive Data Survey" 1960 Edition, By G. A. Helson, Shell Development Company.

If desired, a thin metallic coating of ductile material such as gold may be applied to the outer diameter of ribbon 38 before deposition of dielectric 40. In like manner a coating may be applied to the outer surface of the finish ground dielectric. One purpose of such coating would be to fill any minute voids in the dielectric and thereby assure optimum surface in heat transferring contact. The admixture of a chemically reactive material into such coating material can increase the adhesive strength in the metal-ceramic bonds. Care in the selection must be exercised to prevent an adverse effect on the thermal conductivity. When a coating is to be applied to the outer surface of the dielectric, the mandrel and dielectric may first be ground slightly undersize to compensate for the coating. For purposes of this invention, the dielectric may be regarded as being either with or without coatings since such coatings do not contribute a new function and are well known to the art. If desired, the outer coating may be applied to the inner area of the tubular element 14 of the body member 12.

Figure 5:
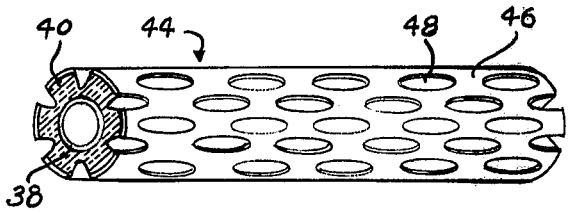
FIG. 5 is a perspective of another species of the invention in which the slow wave structure-mandrel assembly is fitted into a tube and the dielectric is segmented by pierce machining through the tube and segmenting the dielectric.

FIG. 5 depicts a variation of the slow wave structure described above. The slow wave structure 44 is formed by machining the slow wave structure-mandrel assembly as shown in FIG. 2 to finished diameter and then interference fitting it into a tube 46. The assembly may also be brazed in position within the tube. A suitable grinding wheel may be used to pierce machine through the tube 46 at appropriate positions and into the dielectric to a suitable depth. The shape of the openings 48 in the tube will vary with the shape of the cutting tool. If desired, the machining may also be accomplished with a small vertical ene mill. After the cuts have been made to segment the dielectric, the mandrel may be removed by chemical etching; or if desired, the assembly may be fitted into the traveling wave device before the etching operation.

The structure depicted in FIG. 5 has the advantage that the helical structure within the tube may be retained in place with assurance that there were no inadvertent changes in the pitch of the helix, which in turn would have an adverse effect on the electrical function of the traveling wave device. The tube 46 in itself does not influence the function of the slow wave structure, and for all functional purposes the tube may be regarded as a portion of the body structure of the traveling wave device.

Figure 6:
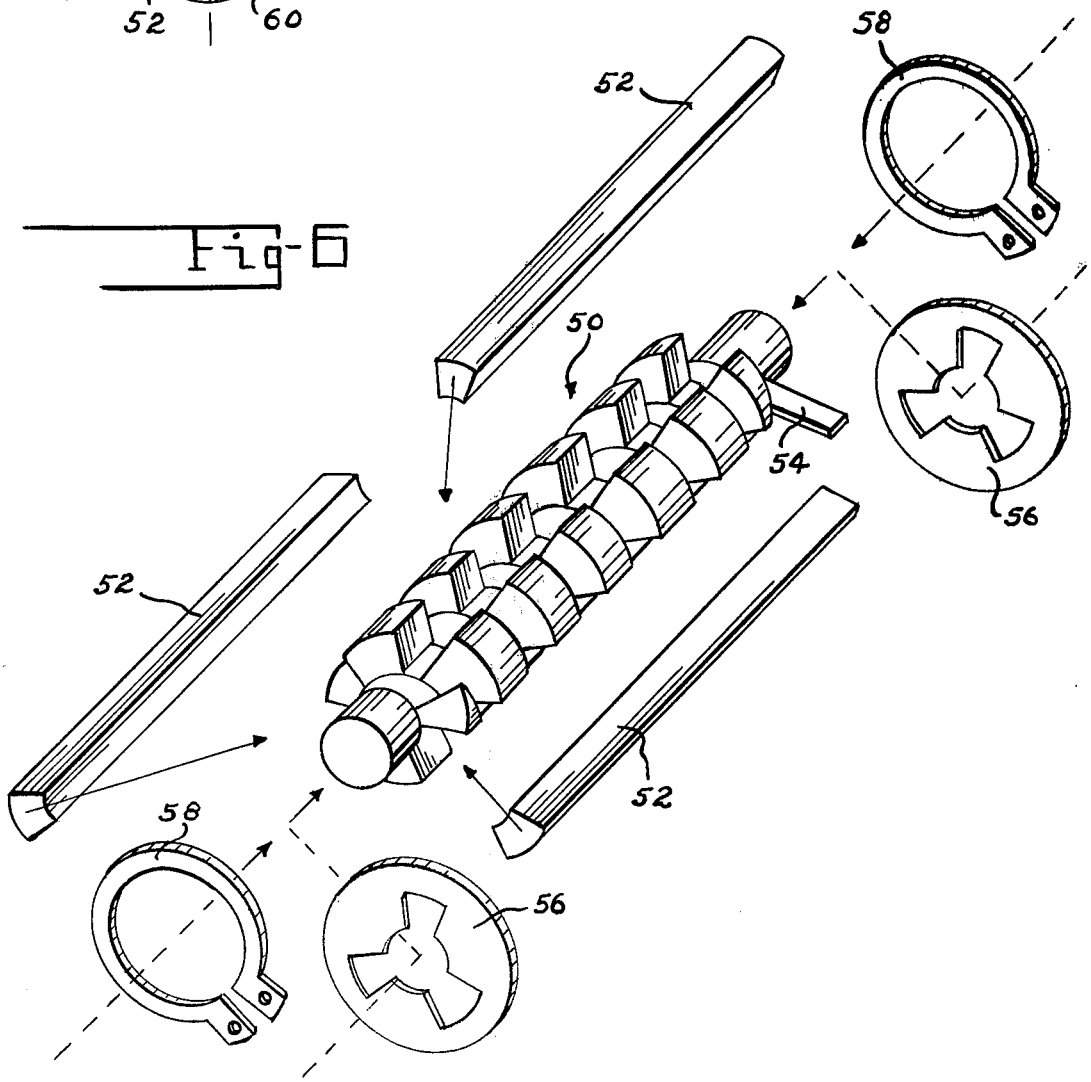
FIG. 6 is an enlarged exploded perspective of a mandrel having longitudinal bars which segment the dielectric at the time the dielectric is applied.

Reference is now made to FIG. 6 which illustrates a mandrel on which a third variation of the segmented dielectric helical slow wave structure is fabricated. The mandrel has a central element 50 which is comparable to the mandrel 42 depicted in FIG. 2 with modifications. The central element 50 is identical with mandrel 42 insofar as having the same helical thread cut to a root diameter comparable to the inside diameter of the slow wave structure to be formed.

The modification is to machine longitudinal slots through the helical threads on the mandrel, the longitudinal slots to receive bars 52. The bottom of the slots are machined to be comparable with the outside diameter of ribbon 54 which forms the inner metallic helix of the slow wave structure after it is wound against the root diameter of the helical thread on the mandrel. The next step is to put the bars 52 into the slots in the mandrel where they are held in position by means of the contoured retaining washers 56 which in turn are held in place by conventional snap washers 58.

Figure 8:
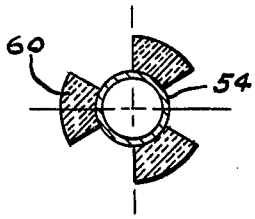
Figure 7:
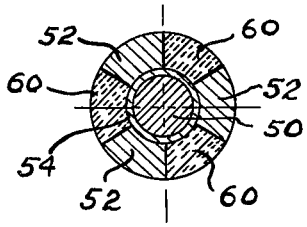
FIG. 7 is a typical transverse cross-section of a slow wave structure-mandrel assembly as shown in FIG. 6 after the assembly has been machined to proper diameter; and, FIG. 8 is a transverse cross-section as shown in FIG. 7 after the disposable mandrel has been chemically etched to leave the finished slow wave structure having segmented dielectric support elements.

After the elements of the mandrel have been assembled, the dielectric is deposited into the remaining cavities along the mandrel. A typical transverse cross-section through the mandrel assembly after the dielectric has been deposited is depicted in FIG. 7. This assembly is now finish machined in the manner previously described. After the mandrel 50 and bars 52 have been removed by chemical etching, a typical transverse cross-section of the slow wave structure which has been formed will be as depicted in FIG. 8. The slow wave structure formed on the mandrel assembly depicted in FIG. 6 is basically the same slow wave structure formed on the mandrel depicted in FIG. 2; the difference being in the method of segmenting the dielectric. Whereas the segments are machined when the slow wave structures are formed on mandrels depicted in FIG. 2, structures formed on the FIG. 6 mandrels are segmented by the bars 52.

Within the scope of the present invention, a segmented dielectric support is one in which the peripheral surface envelope of the dielectric is scored to reduce the dielectric contact area on the peripheral surface envelope. The dielectric may be scored to any suitable width and to any depth including the full thickness of the dielectric. The scoring may be produced by the configuration of the disposable mandrel on which the dielectric is applied to the peripheral surface of the inner metallic core, or, it may be produced by machining operation after the dielectric has been applied to the mandrel.

It is to be understood that the embodiments of the present invention as shown and described are to be regarded as merely illustrative, and that the invention is susceptible to variations, modifications and changes, without regard to specific construction methods, within the scope of the appended claims.

I claim:

1. A traveling wave device comprising:

(a) a body member having a longitudinal tubular element;

(b) an elongated unific slow wave structure having a plurality of segmented dielectric supports in intimate contact within the tubular element of said body member, said slow wave structure comprising a metallic core having a maximum inside diameter of 0.3 cm and with predetermined electrical characteristics over a predetermined frequency range, and a plurality of segmented dielectric supports particulate deposition deposited to the peripheral surface of said metallic core to form said unific slow wave structure;

(c) means within said body member spaced from the first end of and coaxial with said slow wave structure for generating and projecting an electron beam through said slow wave structure;

(d) RF energy means joined to said slow wave structure, the electron beam interacting with and amplifying the RF energy flowing through said traveling wave device;

(e) magnetic means surrounding said body member for producing a magnetic field guiding the electron beam; and, (f) collector means within said body member spaced from the second end of said slow wave structure for collecting the spent electron beam.

2. A traveling wave device in accordance with claim 1 wherein the metallic core of said slow wave structure is of helical configuration.

3. An elongated unific slow wave structure for a traveling wave device or the like, comprising:

(a) an elongated metallic core having a maximum inside diameter of 0.3 cm and with predetermined electrical characteristics over a predetermined frequency range; and, (b) a plurality of segmented dielectric supports particulate deposition deposited to the peripheral surface of said metallic core to form said unific slow wave structure.

4. A slow wave structure in accordance with claim 3 wherein said dielectric is a ceramic.

5. A slow wave structure in accordance with claim 3 wherein said metallic core is of helical configuration.

6. A method of making an elongated unific slow wave structure having a metallic core having a maximum inside diameter of 0.3 cm and bonded on the peripheral surface thereof with a plurality of segmented dielectric supports, said method comprising the steps:

(a) forming a disposable mandrel externally configured to support said metallic core with the peripheral surface exposed;

(b) applying a dielectric particulate deposition to the peripheral surface of said metallic core;

(c) machining the dielectric to a predetermined diameter;

(d) machining the periphery of the dielectric longitudinally on said slow wave structure to form a plurality of segmented dielectric supports on the periphery of said slow wave structure; and, (e) disposing said mandrel by chemical etching.

7. A method of making a slow wave structure in accordance with claim 6 in which the dielectric is a ceramic.

8. A method of making a slow wave structure in accordance with claim 6 in which the dielectric is plasma sprayed ceramic.

9. A method of making an elongated unific slow wave structure having an helical metallic core having a maximum inside diameter of 0.3 cm and bonded on the peripheral surface thereof with a plurality of segmented dielectric supports, said method comprising the steps:

(a) forming an elongated disposable central mandrel element externally configured to nest and support said helical metallic core, said central mandrel element further having a plurality of longitudinal slots substantially parallel to the longitudinal axis of said central mandrel element and circumferentially spaced on the periphery of said central mandrel element and receiving and nesting matching disposable bars after said helical metallic core is wound on said central mandrel element;

(b) applying a dielectric particulate deposition to the peripheral surface of said helical metallic core;

(c) machining the dielectric to a predetermined diameter; and, (d) chemically disposing said central mandrel element and said disposable bars to leave said unific slow wave structure.

10. A method of making a slow wave structure in accordance with claim 9 in which the dielectric is a ceramic.

11. A method of making a slow wave structure in accordance with claim 9 in which the dielectric is plasma sprayed ceramic.

12. A method of making an elongated unific slow wave structure having an helical metallic core having a maximum inside diameter of 0.3 cm and bonded on the peripheral surface thereof with a plurality of segmented dielectric supports, said method comprising the steps:

(a) forming an elongated disposable central mandrel element externally configured to nest and support said helical metallic core, said central mandrel element further having a plurality of longitudinal slots substantially parallel to the longitudinal axis of said central mandrel element and circumferentially spaced on the periphery of said central mandrel element and receiving and nesting matching disposable bars after said helical metallic core is wound on said central mandrel element, said longitudinal slots being of such depth permitting the inner edge of said disposable bars being proximate to the periphery of said helical metallic core;

(b) applying a dielectric particulate deposition to the peripheral surface of said metallic helical core;

(c) machining the dielectric to a predetermined diameter; and, (d) chemically disposing said central mandrel element and said disposable bars to leave said unific slow wave structure.

13. A traveling wave device comprising:

(a) a body member having a longitudinal tubular element;

(b) an elongated unific slow wave structure in intimate contact within the tubular element of said body member, said slow wave structure comprising an open ended tubular containment element coaxially surrounding and retaining in fixed relationship an inner elongated helical metallic core having a maximum inside diameter of 0.3 cm and having predetermined electrical characteristics over a predetermined frequency range, and an intermediate dielectric particulate deposition deposited to the peripheral surface of said helical metallic core, said containment element and said dielectric being spot pierce machined through the periphery of said containment element dividing said dielectric into a plurality of segmented dielectric supports between said metallic core and the inner surface of said containment element;

(c) means within said body member spaced from the first end of and coaxial with said slow wave structure for generating and projecting an electron beam through said slow wave structure;

(d) RF energy means joined to said slow wave structure, the electron beam interacting with and amplifying the RF energy flowing through said traveling wave device;

(e) magnetic means surrounding said body member for producing a magnetic field guiding the electron beam; and, (f) collector means within said body member spaced from the second end of said slow wave structure for collecting the spent electron beam.

14. An elongated unific slow wave structure for a traveling wave device or the like, comprising: an open ended tubular containment element surrounding and retaining in fixed relationship an inner elongated helical metallic core having a maximum inside diameter of 0.3 cm and having predetermined electrical characteristics over a predetermined frequency range, and an intermediate dielectric particulate deposition deposited to the peripheral surface of said metallic core, said containment element and said dielectric being spot pierce machined through the periphery of said containment element dividing said dielectric into a plurality of segmented dielectric supports between said metallic core and the inner surface of said containment element.

15. A slow wave structure in accordance with claim 14 wherein said dielectric is a ceramic.

16. A method of making an elongated unific slow wave structure having a helical metallic core having a maximum inside diameter of 0.3 cm and bonded on the peripheral surface thereof with a plurality of segmented dielectric supports retainably supporting said helical metallic core within a tubular containment element, said method comprising the steps:

(a) forming a disposable mandrel externally configured to support said helical metallic core with the peripheral surface exposed;

(b) applying a dielectric particulate deposition to the peripheral surface of said helical metallic core;

(c) machining the periphery of said dielectric to predetermined diameter;

(d) retainably installing said mandrel with said helical metallic core and said dielectric within an open ended tubular containment element;

(e) spot pierce machining through the periphery of said containment element dividing said dielectric into a plurality of segmented dielectric supports between said helical metallic core and the inner surface of said containment element; and, (f) disposing said mandrel by chemical etching.

17. A method of making a slow wave structure in accordance with claim 16 in which the dielectric is a ceramic.

18. A method of making a slow wave structure in accordance with claim 16 in which the dielectric is plasma sprayed ceramic.

* * * * *